United States Patent [19]

Kahrau

[11] Patent Number: 4,651,758

[45] Date of Patent: Mar. 24, 1987

[54] APPARATUS FOR DETECTING FOREIGN OBJECTS IN THE DISTRIBUTOR OF A CIGARETTE MAKER

[75] Inventor: Jürgen Kahrau, Hamwarde, Fed. Rep. of Germany

[73] Assignee: Hauni-Werke Körber & Co. KG., Hamburg, Fed. Rep. of Germany

[21] Appl. No.: 774,660

[22] Filed: Sep. 11, 1985

[30] Foreign Application Priority Data

Oct. 18, 1984 [DE] Fed. Rep. of Germany ..... 3438174

[51] Int. Cl.[4] ..... A24C 5/39; A24C 5/18

[52] U.S. Cl. ..... 131/109.2; 131/909; 131/108; 131/110; 198/524; 198/534; 198/622

[58] Field of Search ..... 131/108, 109.1, 109.2, 131/110, 909; 19/0.2, 105, 97.5; 198/524, 534, 622, 856; 209/548

[56] References Cited

U.S. PATENT DOCUMENTS 4,167,803 9/1979 Teichmann ..... 19/0.2
4,185,644 1/1980 Heitmann et al. ..... 131/109.1
4,373,538 2/1983 Steiniger ..... 131/108
4,463,768 8/1984 Quarella ..... 131/108
4,530,134 7/1985 Hosel ..... 19/105

*Primary Examiner*—V. Millin
*Assistant Examiner*—H. Macey
*Attorney, Agent, or Firm*—Peter K. Kontler

[57] ABSTRACT

The distributor of a cigarette maker has an upwardly travelling conveyor which transports particles of tobacco past a rotating paddle wheel serving to remove the surplus of particles and to return the removed surplus into the magazine of the distributor. The paddle wheel is connected with a tachometer generator or is designed to actuate a switch in response to a reduction of its rotational speed and/or in response to deflection by one or more foreign objects in the mass of tobacco particles on the conveyor. The signal which is generated by the tachometer generator or in response to actuation of the switch entails a stoppage of the motor for the conveyor and/or of the motor for the paddle wheel.

10 Claims, 2 Drawing Figures

APPARATUS FOR DETECTING FOREIGN OBJECTS IN THE DISTRIBUTOR OF A CIGARETTE MAKER

BACKGROUND OF THE INVENTION

The present invention relates to cigarette makers and analogous machines for forming and processing streams of fibrous material, and more particularly to improvements in apparatus for facilitating the detection and removal of foreign objects from fibrous material, such as batches of tobacco shreds in the distributor of a cigarette making machine.

It is known to provide the distributor of a cigarette making machine with a conveyor which draws tobacco shreds from a magazine and cooperates with a paddle wheel in order to ensure that the next station of the distributor will receive tobacco shreds at a more or less constant rate. Reference may be had, for example, to commonly owned U.S. Pat. No. 4,185,644 and to numerous other patents and pending patent applications of the assignee of the present application.

The presence of relatively small metallic objects in the continuous or intermittent flow of tobacco particles which is formed and advanced in the distributor of a cigarette maker is normally detected by a magnetic roller which is adjacent to the path of movement of tobacco particles toward the cigarette rod forming station However, the flow of tobacco particles in the magazine of the distributor (also known as hopper in Great Britain and in certain other English-speaking countries) is equally likely to carry other foreign objects which may but need not contain metallic substances. For example, the magazine can receive (at randomly spaced intervals) fragments of cloth, fragments of paper and/or other rather bulky foreign objects which can interfere with proper operation of the machine and whose belated detection can result in the making of thousands of defective articles and/or in extensive damage to the distributor. For example, a piece of cloth or other textile material caught by the carding and/or other protruding parts on the belt conveyor which draws tobacco shreds from the magazine of the distributor can cause deformation and/or breakage of the protruding parts which, in turn, necessitates the removal and replacement of the entire conveyor with attendant huge losses in the output of a machine which is designed to turn out up to and in excess of 8000 rod-shaped articles per minute. Moreover, even short-lasting stoppage of a cigarette maker necessitates the idling of an entire production line which can include a filter rod making machine, a packing machine, a carton filling machine and/or others.

OBJECTS AND SUMMARY OF THE INVENTION

An object of the invention is to provide a novel and improved distributor which can be used with advantage in a cigarette maker and is constructed and assembled in such a way that foreign objects which happen to enter its magazine are detected before they can cause extensive, or even minor, damage to the distributor and/or to other parts or units of the machine.

Another object of the invention is to provide a distributor wherein foreign objects can be detected and removed before they advance well beyond the magazine for fibrous material.

A further object of the invention is to provide a distributor wherein the detection of foreign objects can be achieved with parts which are needed in the distributor to perform other desirable and useful functions.

An additional object of the invention is to provide a novel and improved surplus removing device for use in the distributor of a cigarette rod making or like machine.

Still another object of the invention is to provide the distributor with novel and improved means for warning the attendant or attendants that a foreign object has been found in the flow of fibrous material which is to be converted into the filler of a cigarette rod or the like.

Another object of the invention is to provide a cigarette making machine which embodies the above outlined distributor.

A further object of the invention is to provide a method of reliably detecting bulky foreign objects in the mass of shredded tobacco which is being drawn from the magazine of the distributor in a cigarette maker or a like machine.

An additional object of the invention is to provide a distributor wherein the provision of means for detecting foreign objects does not contribute significantly, or does not contribute at all, to the bulk and/or complexity of the distributor and/or of the machine wherein the distributor is put to use.

The invention is embodied in a distributor for use in machines for forming a stream or flow of tobacco or a like fibrous material. The distributor comprises a source of fibrous material which, at times, contains foreign objects (such as fragments of cloth or the like), conveyor means for advancing fibrous material from the source with a surplus in excess of that which is necessary to form the flow, drive means for the conveyor means, means for removing the surplus of fibrous material from the conveyor means including signal generating means for monitoring the fibrous material in order to detect the presence of foreign objects, and control means for influencing the drive means in response to signals from the monitoring means, i.e., in response to detection of a foreign object.

In accordance with one presently preferred embodiment of the invention, the monitoring means comprises a rotary member (such as a wheel with one or more orbiting paddles), and the distributor further comprises drive means for the rotary member. The control means is designed to influence the drive means for the rotary member in response to signals from the monitoring means. The monitoring means can generate signals in response to direct or indirect contact with a foreign object on or in the conveyor means. For example, a foreign object can press fibrous material toward and into engagement with the paddle or paddles of the aforementioned wheel, or such paddle or paddles can come into direct contact with a foreign object in the form of a piece of textile material or the like. The control means can include means for arresting at least one of the drive means in response to a signal from the monitoring means, and at least one of the drive means can include a variable-speed electrically or otherwise powered motor. The conveyor means can define an upwardly sloping path for the fibrous material, and the paddle or paddles of the aforementioned wheel are then arranged to orbit along a second path which is adjacent to a predetermined portion of the path for fibrous material on or in the conveyor means.

The monitoring means is or can be designed to generate signals denoting the rotational speed of the rotary member, and the control means can include means for influencing the drive means for the conveyor means and/or the drive means for the rotary member in response to signals denoting that the rotational speed of the rotary member is below a predetermined threshold value, e.g., a value which is indicative that the RPM of the rotary member has been reduced as a result of direct or indirect engagement of one or more paddles with a relatively large object such as a fragment of cloth, a piece of paper, a metallic object, a large fragment of a tobacco rib or the like.

In addition to or in lieu of responding to a change in the rotational speed of a rotary member (such as a paddle wheel), the control means can be designed to respond to changes in the position of the rotary member, e.g., to a pivotal movement of the rotary member about an axis which is inclined with reference to the axis of rotation of the rotary member. The rotary member can be mounted for translatory and/or pivotal movement away from the path for fibrous material in or on the conveyor means in response to engagement by the surplus which overlies a foreign object or in response to direct contact with the foreign object. This entails the generation of one or more signals which enable the control means to influence the one and/or the other drive means, e.g., to arrest the drive means for the conveyor means as well as to arrest the drive means for the rotary member.

The novel features which are considered as characteristic of the invention are set forth in particular in the appended claims. The improved distributor itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
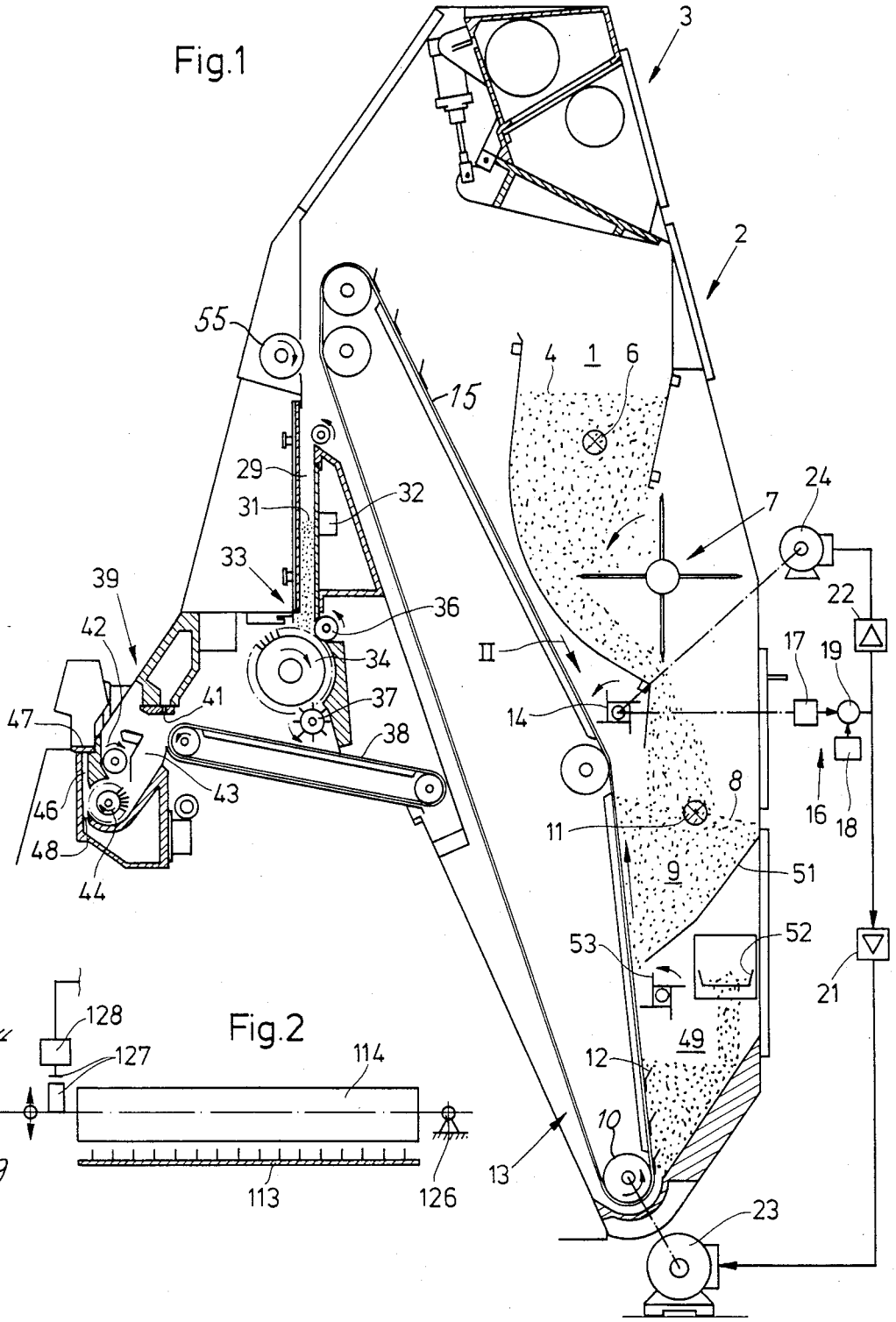
FIG. 1 is a partly schematic in part elevational and in part vertical sectional view of a distributor which embodies one form of the invention.

FIG. 1 shows the distributor of a cigarette rod making machine. The distributor comprises a first or upper magazine 1 which forms part of the so-called primary distributor unit 2 and receives batches of tobacco particles in response to intermittent opening of a gate 3. The gate is opened in response to signals from a photocell 6 which is installed in the magazine 1 and generates a signal whenever the supply 4 of tobacco particles in the magazine shrinks to an extent such that the photocell 6 becomes exposed. A rotatable wheel-shaped rake 7 transfers particles of tobacco from the lower portion of the magazine 1 into a second magazine 9 wherein the supply 8 of tobacco particles is monitored by a second photocell 11. The photocell 11 generates signals which are used to drive the rake 7 at such frequency and for such intervals of time that the level of the upper side of the supply 8 in the magazine 9 remains at least substantially constant.

The distributor further comprises a conveyor 13 which includes an endless belt trained over several pulleys including a driven pulley 10 and having an ascending reach 15 provided with pockets 12 for portions or batches of tobacco particles which are withdrawn from the supply 8 and are dumped into an upright duct 29. The means for equalizing the batches which are picked up by successive pockets 12 on the ascending reach 15 of the conveyor 13 includes a rotary member in the form of a paddle wheel 14 which is driven by a variable-speed electric motor 24 or another suitable prime mover. The means for driving the pulley 10 comprises a variable-speed electric motor 23.

In accordance with a feature of the invention, the paddle wheel 14 (whose paddles can constitute strips of leather or other flexible material to brush off the excess or surplus of fibrous material which is transported by the pockets 12 past that portion of the path for the pockets which is adjacent to the paddle wheel) constitutes one element of a monitoring device which detects the presence or absence of foreign objects (such as fragments of textile material or the like) in or adjacent to the pockets 12. The monitoring device further comprises a tachometer generator 17 which generates signals denoting the RPM of the paddle wheel 14. The signals which appear at the output of the tachometer generator 17 are transmitted to a control unit 16 which includes a source 18 of reference signals (e.g., an adjustable potentiometer), a signal comparing stage 19, and two amplifiers 21, 22 which are respectively in circuit with the motors 23 and 24.

When a foreign object (e.g., a piece of cloth) enters the space between the respective pocket 12 and the path of orbital movement of paddles on the wheel 14, it tends to reduce the RPM of the paddle wheel 14 (which is driven to rotate in a counterclockwise direction, as viewed in FIG. 1) and, when the RPM of the paddle wheel is reduced below a preselected threshold value (which can be selected by the source 18 of reference signals), the stage 19 transmits a signal which influences the motors 23, 24 for the conveyor 13 and paddle wheel 14. In accordance with a presently preferred embodiment of the invention, the signals which are transmitted by the stage 19 (when the intensity and/or another characteristic of the signal from the tachometer generator 17 deviates from the corresponding characteristic(s) of the signal which is transmitted by the source 18 to a predetermined extent) cause the motors 23, 24 to come to a halt so that the operation of the distributor is interrupted. The attendants then rapidly remove the foreign object from the conveyor 13, i.e., before the foreign object can cause more or less extensive damage to the conveyor 13, its protruding parts 12 and/or to the duct 29 and the parts which are adjacent to and/or follow the duct. The motors 23, 24 are normally (but not necessarily) polyphase current electric motors.

The intensity or another characteristic of the reference signal which is furnished by the source 18 can be readily selected in such a way that the monitoring device including the paddle wheel 14 and the tachometer generator 17 reacts to the presence of relatively small, relatively large, relatively thick or bulky and/or relatively small or compact foreign objects. Such foreign objects can come into direct contact with the paddles of the wheel 14 or they can indirectly contact the paddle or paddles through the medium of a layer of fibrous material. All that counts is to ensure that the paddle wheel 14 can respond by reducing its rotational speed so that the tachometer generator can transmit a signal which entails a stoppage of the motors 23, 24 and/or which otherwise influences the paddle wheel 14 and/or the conveyor 13. The resistance which the tobacco particles that extend from their pockets 12 offer to the combing or removing action of paddles on the wheel 14 does not suffice to effect a deceleration which would cause the tachometer generator 17 to transmit a signal of sufficient intensity to initiate a stoppage of the motors 23 and 24. The motors 23 and 24 can be arrested while a foreign object, which has initiated their stoppage, is still in the region of the paddle wheel 14. This enables an attendant to remove such foreign object without any searching and preferably at a location in the distributor which is readily accessible. Detection and removal of foreign objects in the region of the paddle wheel 14 (i.e., as soon as the foreign objects leave the magazine 9) ensures that such foreign objects are removed at the earliest possible time and at a location which is much more readily accessible than many other locations where the particles of tobacco advance toward the rod forming station. Moreover, foreign objects are invariably detected before they can cause any damage or before they cause substantial damage, e.g., to the pockets 12 of the conveyor 13, to the parts in or adjacent to the duct 29 and/or elsewhere in the distributor.

The batches of tobacco particles which are devoid of foreign objects of the type to be detected by the monitoring device 14, 17 are dumped into the duct 29 which accumulates a column 31 of tobacco particles. The upper level of such column is monitored by a set of photocells 32 which generate signals serving to regulate the speed of the motor 23 for the pulley 10. This ensures that the height of the column 31 in the duct 29 remains at least substantially constant.

The discharge end 33 of the duct 29 is located at a level above a rotary carded drum 34 which draws a layer of tobacco shreds from the lower end of the column 31 and cooperates with a tamping or homogenizing roller 36 in order to ensure that the carding of the drum 34 gently accumulates and transports a homogeneous layer of tobacco particles into the range of a picker roller 37. The latter expels the shreds onto the upper reach of a wide belt conveyor 38 serving to accumulate a carpet of uniformly distributed tobacco shreds and to advance such carpet at a predetermined (preferably constant) speed toward and into the range of a classifying device 39. The directions in which the rotary parts 34, 36, 37 and the pulleys for the conveyor 38 are driven are indicated by arrows.

The classifying device 39 has a set of orifices 41 which discharge streamlets of compressed air across the path of tobacco particles advancing beyond the discharge end of the conveyor 38. Such streamlets form a substantially vertical curtain which is traversed by the relatively heavy particles (such as fragments of tobacco ribs) but which can influence the trajectories of lightweight particles (especially shreds of tobacco leaf laminae) to deflect the lightweight particles into a funnel 43. The heavier particles accumulate in an intercepting receptacle 42.

The funnel 43 contains a carded drum 44 which propels satisfactory (lightweight) particles into a channel 46 wherein the particles rise and accumulate at the underside of the lower reach of a tobacco stream forming conveyor 47. The conveyor 47 is foraminous and its lower reach is located above a suction chamber which attracts the ascending particles to the conveyor 47 and cause them to form a growing tobacco stream which is thereupon trimmed, wrapped and otherwise treated in a manner not forming part of the present invention. The distributor of FIG. 1 further comprises a plenum chamber 48 with several outlets which discharge streamlets of compressed air into the lower portion of the channel 46 so that the lightweight particles are compelled to rise and to gather at the underside of the conveyor 47. The arrangement is preferably such that the streams of air issuing from the plenum chamber 48 impart to each ascending tobacco particle a component of movement in the direction of forward movement of the lower reach of the conveyor 47.

The surplus of lightweight tobacco which is removed from the stream at the underside of the lower reach of the conveyor 47 is returned into the distributor, and more particularly into a magazine 49 which is located at a level below the magazine 9 and is adjacent to the lowermost portion of the upwardly advancing reach 15 of the conveyor 13. The magazine 49 is separated from the magazine 9 by a wall 51 (e.g., a sheet-metal panel which constitutes the bottom wall of the magazine 9) and receives lightweight tobacco particles from the trimming station by way of a further conveyor 52. A paddle wheel 53 is installed in the magazine 49 to remove the surplus of lightweight particles from successive pockets 12 so that each of these pockets contains a predetermined quantity of tobacco particles which are taken from the magazine 49 before it reaches and receives additional tobacco particles from the supply 8 in the magazine 9. The conveyor 52 can constitute an endless belt conveyor, a vibratory conveyor or any other suitable means for transporting trimmed-off tobacco particles from the equalizing station below the conveyor 47 to the magazine 49. The paddle wheel 53 is driven to rotate in a counterclockwise direction, as viewed in FIG. 1, so as to brush back the excess of lightweight particles before the respective pockets 12 reach the supply 8 in the magazine 9.

Figure 2:
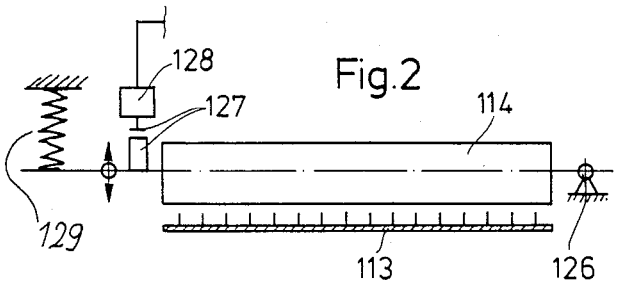
FIG. 2 is a plan view of a paddle wheel which can be used in a modified distributor, the view of FIG. 2 being taken in the direction of arrow II in FIG. 1.

FIG. 2 shows a portion of a modified distributor wherein the means for monitoring the path which is defined by a conveyor 113 (corresponding to the conveyor 13 of FIG. 1) comprises a paddle wheel 114 carrying a trip forming part of a normally open switch 127. The paddle wheel 114 extends transversely of the conveyor 113 and one end portion of its shaft is pivotable about a fulcrum 126 which is installed in the housing of the distributor. The axis which is defined by the fulcrum 126 is normal to the plane of FIG. 2 and to the axis of rotation of the paddle wheel 114. The control means of the distributor which includes the structure of FIG. 2 comprises a circuit 128 which transmits to the amplifiers 21, 22 of FIG. 1 a signal whenever the switch 127 is closed by the paddle wheel 114, namely when the paddle wheel 114 is pivoted about the axis of the fulcrum 126 (in a clockwise direction as viewed in FIG. 2) as a result of direct or indirect engagement with a foreign object on the conveyor 113. The control circuit 128 then influences (e.g., arrests) the motors 23, 24 as a result of detection of a foreign object on the conveyor 113. The reference character 129 denotes a spring which opposes clockwise pivotal movements of the paddle wheel 114 and whose resistance must be overcome in order to close the switch 127. The resistance of the spring 129 can be regulated to thereby select that force which is required to pivot the paddle wheel 114 to the extent that is needed to close the switch 127 and to enable the control circuit 128 to arrest the motors 23 and 24.

The improved distributor is susceptible of many additional modifications. For example, one and the same motor can drive the conveyor 13 or 113 and the paddle wheel 14 or 114. Furthermore, the conveyor 13 or 113 and/or the paddle wheel 14 or 114 can receive motion from the main prime mover of the cigarette making machine through the medium of discrete electromagnetic clutches which then replace the motors 23, 24 and each of which can be disengaged in response to a signal from the control means 16 or 128. The higher energy which is required to rotate the paddle wheel 14 or 114 while the paddle wheel is in direct or indirect contact with a foreign object on the conveyor 13 or 113 is detected and the resulting signal is used to disengage the clutch or clutches so as to ensure that the foreign object is arrested before it reaches the duct 29 or any other sensitive part of the distributor.

The signals which are generated by the tachometer generator 17 can be used to ensure a highly predictable and practically immediate stoppage of the motors 23, 24. The apparatus of FIG. 1 is very sensitive and can be used for detection of a variety of different foreign objects. Metallic particles can be detected by a rotary magnet 55 which is adjacent to the upper end of the duct 29.

An important advantage of the improved distributor is that foreign objects are detected as soon as they are removed from the supply 8, i.e., as close to the inlet (gate 3) of the distributor as possible. Moreover, the monitoring device includes a part (the paddle wheel 14 or 114) which performs another important and useful function so that the improved monitoring means does not contribute to the bulk and complexity of the distributor. The foreign objects can act on the paddle wheel 14 or 114 directly or indirectly to reduce its rotational speed and/or to change its orientation and to thereby cause the generation of a signal which is used to influence the drive means for the conveyor 13 or 113 and/or the drive means for the paddle wheel 14 or 114.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A distributor for use in machines for forming a flow of tobacco or other fibrous material, comprising a source of fibrous material which, at times, contains foreign objects such as fragments of cloth or the like; conveyor means for advancing fibrous material from the source with a surplus in excess of that which is necessary to form the flow; drive means for said conveyor means; means for removing the surplus of fibrous material from said conveyor means, including signal generating means for monitoring the fibrous material in order to detect the presence of foreign objects; and control means for influencing said drive means in response to signals from said monitoring means.

2. The distributor of claim 1, wherein said monitoring means includes a rotary member and further comprising drive means for said rotary member, said control means being arranged to influence the drive means for said rotary member in response to signals from said monitoring means.

3. The distributor of claim 2, wherein said rotary member is a paddle wheel.

4. The distributor of claim 2, wherein said control means includes means for arresting at least one of said drive means in response to said signals.

5. The distributor of claim 2, wherein said monitoring means includes means for generating signals denoting the rotational speed of said rotary member, said control means including means for influencing said drive means in response to signals denoting that the rotational speed of said rotary member is below a predetermined threshold value.

6. The distributor of claim 2, wherein said conveyor means defines for fibrous material a predetermined path and said rotary member is adjacent to and in direct contact with the surplus of fibrous material in a predetermined portion of said path, said rotary member being arranged to move away from said path in response to direct or indirect engagement with a foreign object in said portion of said path and to generate signals in response to such movement thereof.

7. The distributor of claim 6, wherein said rotary member is rotatable about a first axis by the respective drive means and is pivotable about a different second axis by a foreign object in said predetermined portion of said path.

8. The distributor of claim 2, wherein said conveyor means defines an upwardly sloping path and said rotary member includes at least one orbiting paddle adjacent to a portion of said path.

9. The distributor of claim 2, wherein at least one of said drive means comprises a variable-speed motor.

10. The distributor of claim 1, wherein said monitoring means is arranged to generate signals in response to direct or indirect contact with a foreign object on said conveyor means.

* * * * *